US010267052B1

(12) United States Patent
Christopherson et al.

(10) Patent No.: US 10,267,052 B1
(45) Date of Patent: Apr. 23, 2019

(54) RETRACTABLE CANOPY FOR A PORTABLE SPA HOT TUB

(71) Applicants: Daniel John Christopherson, Aguanga, CA (US); John Guy Cazort, III, Corona del Mar, CA (US)

(72) Inventors: Daniel John Christopherson, Aguanga, CA (US); John Guy Cazort, III, Corona del Mar, CA (US)

(73) Assignee: Daniel Christopherson, Aguanga, CA (US)

( * ) Notice: Subject to any disclaimer, the term of this patent is extended or adjusted under 35 U.S.C. 154(b) by 0 days.

(21) Appl. No.: 15/892,995

(22) Filed: Feb. 9, 2018

(51) Int. Cl.
*E04H 4/10* (2006.01)

(52) U.S. Cl.
CPC ..... *E04H 4/108* (2013.01)

(58) Field of Classification Search
CPC ..... E04H 4/108
USPC ..... 4/498, 503
See application file for complete search history.

(56) References Cited

U.S. PATENT DOCUMENTS 7,721,361 B1 * 5/2010 Shubert ..... E04H 4/108 4/498
2008/0244820 A1 * 10/2008 Moore ..... E04H 4/108 4/498

* cited by examiner

*Primary Examiner* — Tuan N Nguyen

(57) ABSTRACT

A retractable canopy for use with a portable spa hot tub is provided. The retractable canopy includes a U-shaped bow having a pair of end members pivotably mounted to the spa hot tub, each end member of the U-shaped bow having a gear mechanism, a pair of spring-loaded levers coupled to the spa hot tub, each spring-loaded lever having a protrusion that communicates with the gear mechanism of one of the end members of the U-shaped bow, and a fabric member coupled to the U-shaped bow and spa hot tub. The U-shaped bow pivotably adjusts to one of a plurality of locking positions to expand or collapse the fabric member and may include lighting along the bow perimeter.

1 Claim, 3 Drawing Sheets

RETRACTABLE CANOPY FOR A PORTABLE SPA HOT TUB

BACKGROUND

The embodiments herein relate generally to a canopy designed to protect a user from sun rays. More specifically, embodiments of the invention are directed to a canopy for spa hot tubs.

Portable spa hot tubs are often used outdoors at homes, hotels, resorts and other locations for relaxation. Each hot tub comprises a container to store water and permit a user to completely or partially submerge his/her body therein. Current spa hot tubs are open and subject users to direct sun rays. In addition, these hot tubs are limited because they do not provide users with privacy from other neighbors.

As such, there is a need in the industry for a retractable canopy for a portable spa hot tub that addresses the limitations of the prior art.

SUMMARY

A retractable canopy for use with a portable spa hot tub is provided. The retractable canopy comprises a U-shaped bow comprising a pair of end members pivotably mounted to the spa hot tub, each end member of the U-shaped bow comprising a gear mechanism, a pair of spring-loaded levers coupled to the spa hot tub, each spring-loaded lever comprising a protrusion configured to communicate with the gear mechanism of one of the end members of the U-shaped bow, and a fabric member coupled to the U-shaped bow and spa hot tub, wherein the U-shaped bow is configured to pivotably adjust to one of a plurality of locking positions to expand or collapse the fabric member. Additionally, lighting may be mounted to the bow to illuminate the interior of the spa hot tub.

DETAILED DESCRIPTION OF CERTAIN EMBODIMENTS

Figure 1:
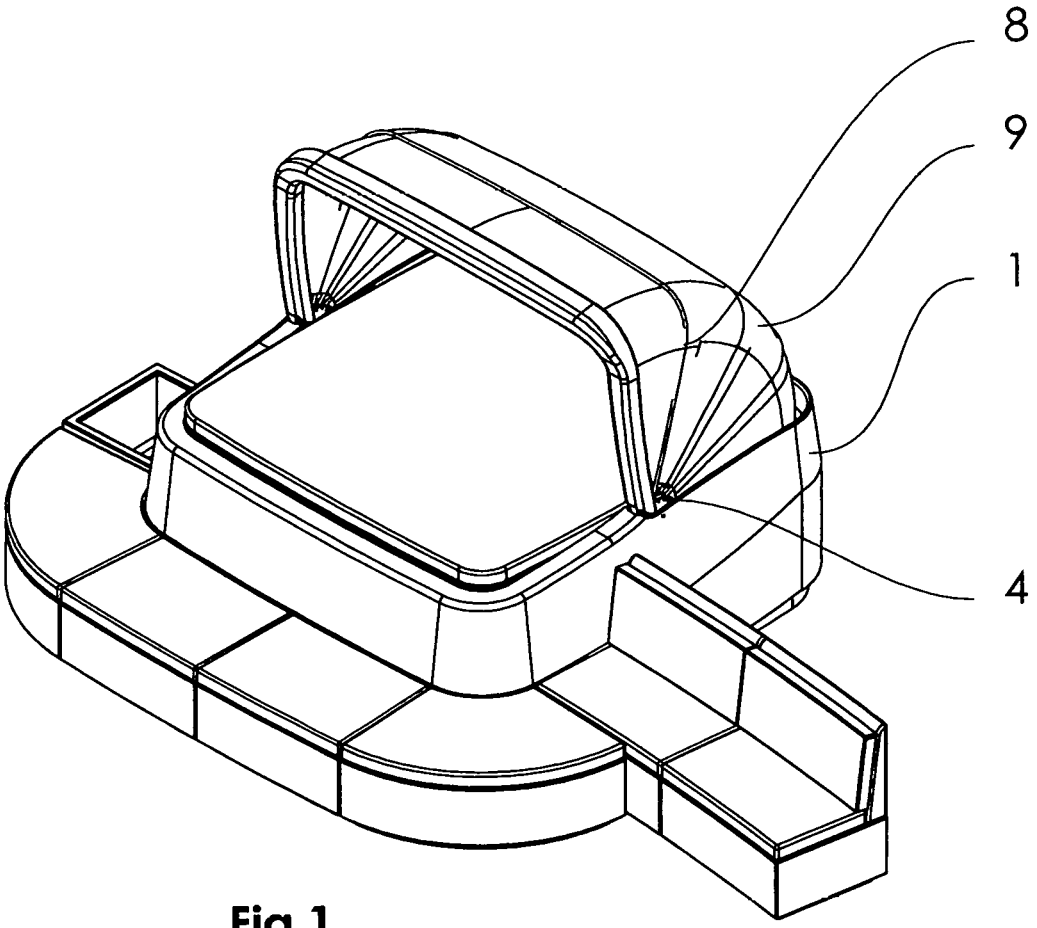
FIG. 1 is an isometric view of the invention with the canopy in the open position.
Figure 2:
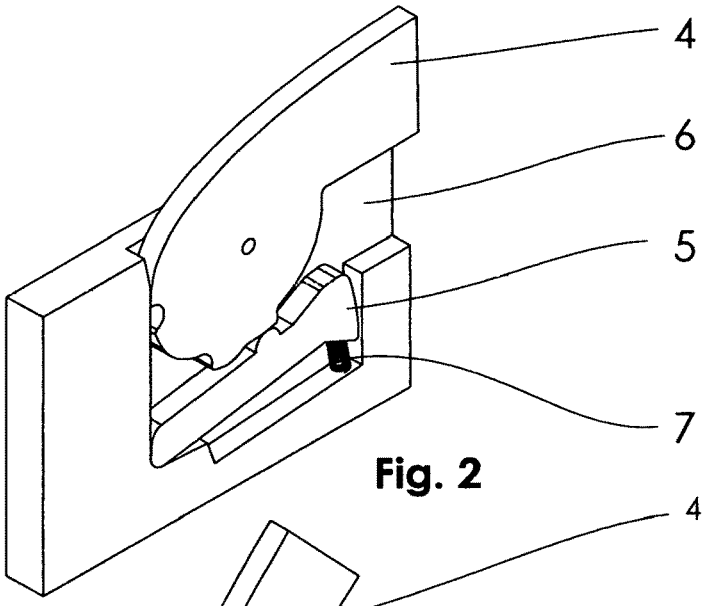
FIG. 2 is an isometric view of the detent gear mechanism assembly with the canopy in the closed position.
Figure 3:
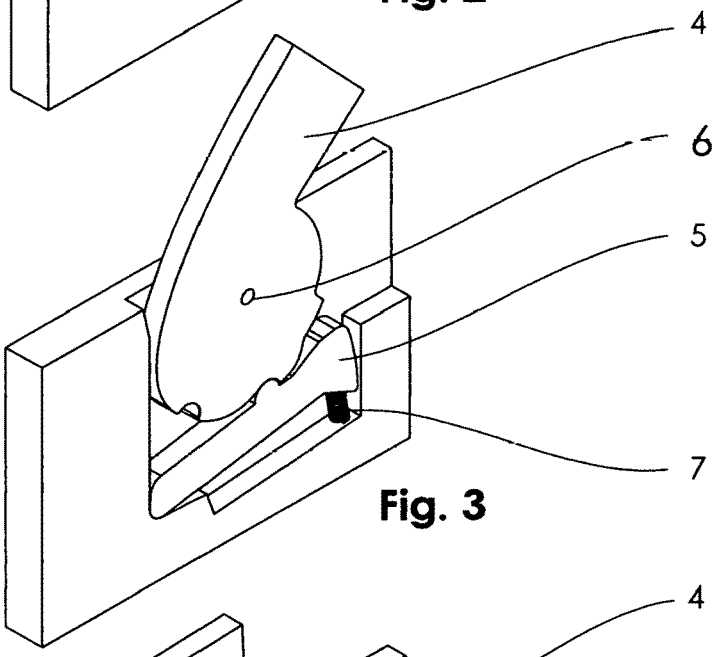
FIG. 3 is an isometric view of the detent gear mechanism assembly with the canopy in a mid-position.
Figure 4:
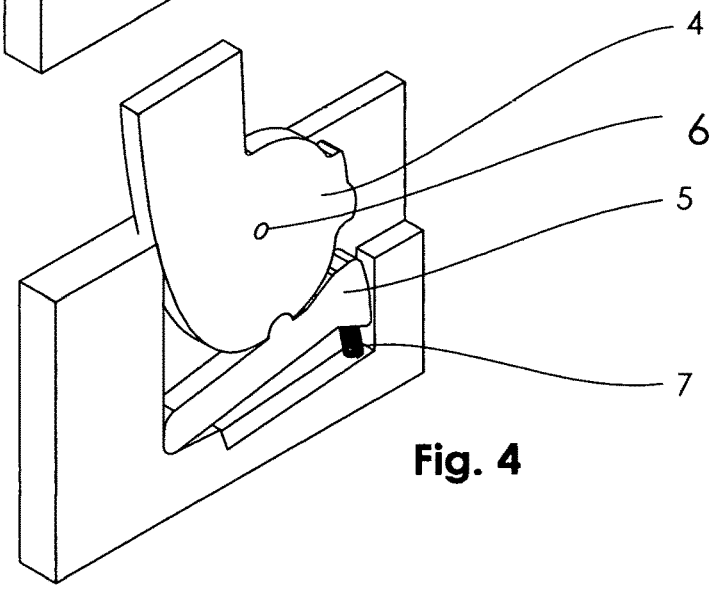
FIG. 4 is an isometric view of the detent gear mechanism assembly with the canopy in the open position.
Figure 5:
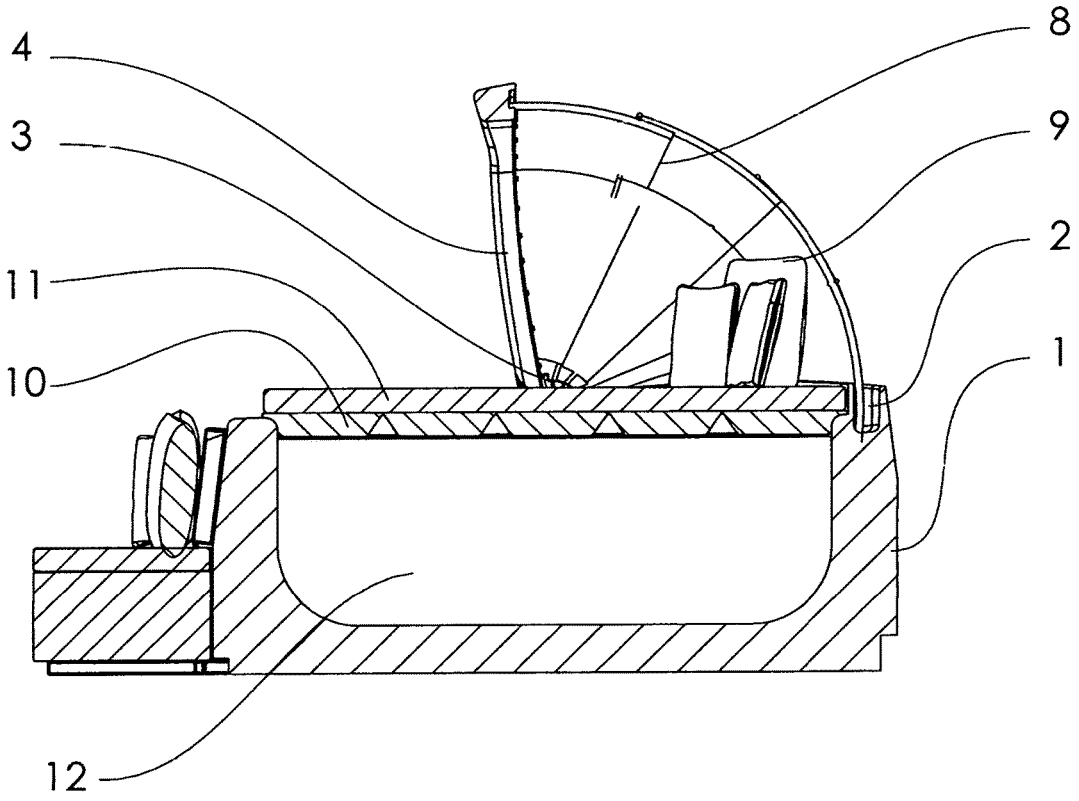
FIG. 5 is a cross section view of the Invention with the canopy in the open position

In certain embodiments of the invention, the retractable canopy generally comprises a U-shaped bow comprising a pair of end members pivotably mounted to the spa hot tub, each end member of the U-shaped bow comprising a gear mechanism, a pair of spring-loaded levers coupled to the spa hot tub, each spring-loaded lever comprising a protrusion configured to communicate with the gear mechanism of one of the end members of the U-shaped bow, and a fabric member coupled to the U-shaped bow and spa hot tub.

In certain embodiments of the invention, the hot tub retractable canopy comprises the following components/features: (1) a portable hot tub, (2) U-shaped receiver, (3) detent gear mechanism assembly, (4) molded high-density polyethylene(HDPE) plastic bow with integrated gear head mechanism, (5) detent pawl levers, (6) stainless steel axles, (7) coiled stainless steel springs, (8) U-shaped aluminum ribbing assemblies, (9) fabric covering, (10) molded high-density plastic (HDPE) hot tub water cover, and (11) LED lighting.

The portable hot tub may have various sizes and is configured to be used with a structurally integrated, adjustable and collapsible shade canopy. The plastic bow has a U-shape and comprises a pair of ends comprising integrated gear head mechanisms. Each gear head mechanism on the U-shaped bow comprises a plurality of grooves. In one embodiment, the plastic bow is pivotably mounted to the portable hot tub by stainless steel axles.

A pair of detent pawl levers are coupled to the portable hot tub and are operably connected to the coiled stainless-steel springs. Each detent pawl lever comprises a protrusion that communicates with grooves of one of the gear head mechanisms of the U-shaped bow. As the plastic bow pivotably adjusts, the protrusions of the detent pawl levers engage with corresponding grooves on the U-shaped bow gear head mechanisms to lock the bow in one of a plurality of positions.

An opaque fabric covering is coupled to the plastic bow and portable hot tub. In one embodiment, a plurality of U-shaped ribbing assemblies are pivotably mounted to the hot tub and coupled to the fabric covering. The ribbing assemblies provide additional support to the fabric covering as it expands and collapses.

In operation, the portable hot tub is filled with water. The U-shaped bow is pivotably adjusted to one of the plurality of locking positions to expand or compress the fabric covering to the desired level of sun and privacy protection. In one embodiment, a U-shaped receiver is positioned at the edge of the hot tub. The U-shaped receiver comprises a double wall design that creates a pocket configured to permit the fabric covering to fold therein when the canopy collapses. In the fully collapsed position, the folded fabric covering, the integrated gear head mechanisms, the detent pawl levers and the coiled springs are concealed by the plastic bow.

In an alternative embodiment, a molded high-density plastic (HDPE) hot tub water cover with a top pad can be disposed on top of the hot tub to maintain the water temperature and convert the hot tub into a useable day bed with a canopy. Matching furniture including, but not limited to, chairs, tables, pillows, and the like, may be used with the portable hot tub/bed setup. In an alternative embodiment, a plurality of light-emitting diodes or other lighting devices may be coupled to the plastic bow, hot tub, or other nearby areas to illuminate the hot tub/bed.

It shall be appreciated that the retractable canopy described in several embodiments herein may comprise any known materials in the field and be of any color, size and/or dimensions. It shall be appreciated that the components of the retractable canopy described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A retractable canopy for use with a portable spa hot tub, the retractable canopy comprising:

a U-shaped bow comprising a pair of end members pivotably mounted to the spa hot tub, each end member of the U-shaped bow comprising a gear mechanism;

a pair of spring-loaded levers coupled to the spa hot tub, each spring-loaded lever comprising a protrusion configured to communicate with the gear mechanism of one of the end members of the U-shaped bow; and a fabric member coupled to the U-shaped bow and the spa hot tub;

wherein the U-shaped bow is configured to pivotably adjust to one of a plurality of locking positions to expand or collapse the fabric member.

* * * * *